United States Patent [19]

Racs

[11] Patent Number: 4,653,955

[45] Date of Patent: Mar. 31, 1987

[54] RETROREFLECTIVE DEVICE HAVING CURVED RETROREFLECTIVE SURFACE

[75] Inventor: Robert R. Racs, Flint, Tex.

[73] Assignee: Ferro Corporation, Cleveland, Ohio

[21] Appl. No.: 860,443

[22] Filed: May 7, 1986

[51] Int. Cl.[4] ..... E01F 9/06

[52] U.S. Cl. ..... 404/14; 404/16; 116/63 R; 350/104; D10/113

[58] Field of Search ..... 404/12, 14, 16, 6, 9, 404/15, 72, 73; 116/63 R; D10/113; 350/104

[56] References Cited

U.S. PATENT DOCUMENTS

D. 190,606 6/1961 Angier .
D. 210,329 2/1968 Keats .
2,303,462 12/1942 Horne .
3,240,132 3/1966 Wiswell ..... 404/16
3,277,800 10/1966 Wiswell ..... 404/16

FOREIGN PATENT DOCUMENTS 786551 6/1935 France ..... 404/16
501763 11/1954 Italy ..... 404/16
1104379 2/1968 United Kingdom ..... 404/14

*Primary Examiner*—Carl D. Friedman
*Assistant Examiner*—R. Chilcot, Jr.
*Attorney, Agent, or Firm*—Milton L. Simmons

[57] ABSTRACT

There is disclosed a highway lane divider and road marker, having a relatively low profile, characterized by the inventive feature of a unidirectionally curved retroreflective element, as opposed to planar retroreflective elements used heretofore.

3 Claims, 8 Drawing Figures

FIG. 1
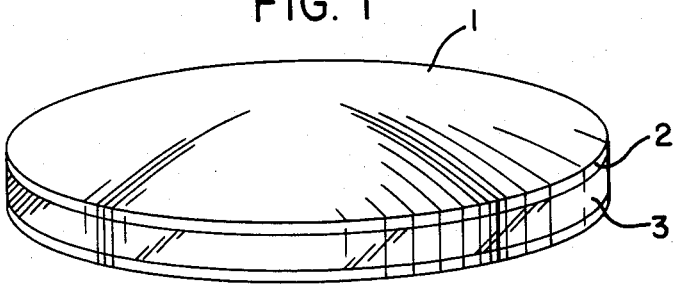
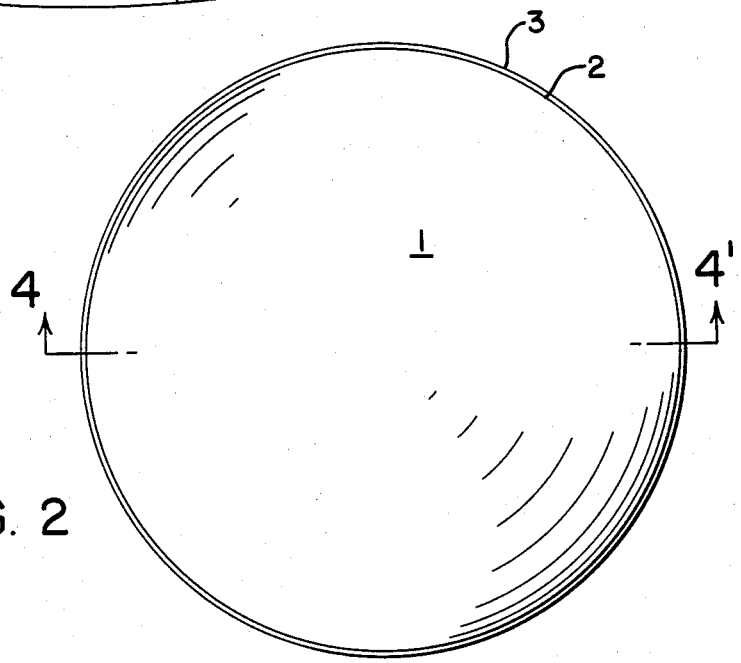
FIG. 2
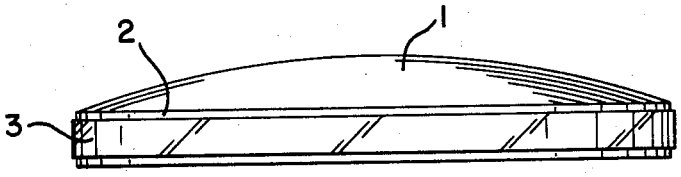
FIG. 3
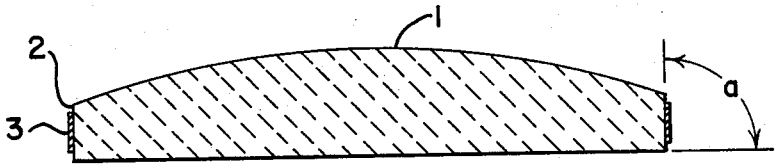
FIG. 4

FIG. 5
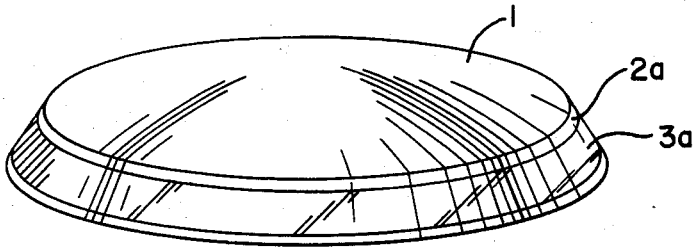
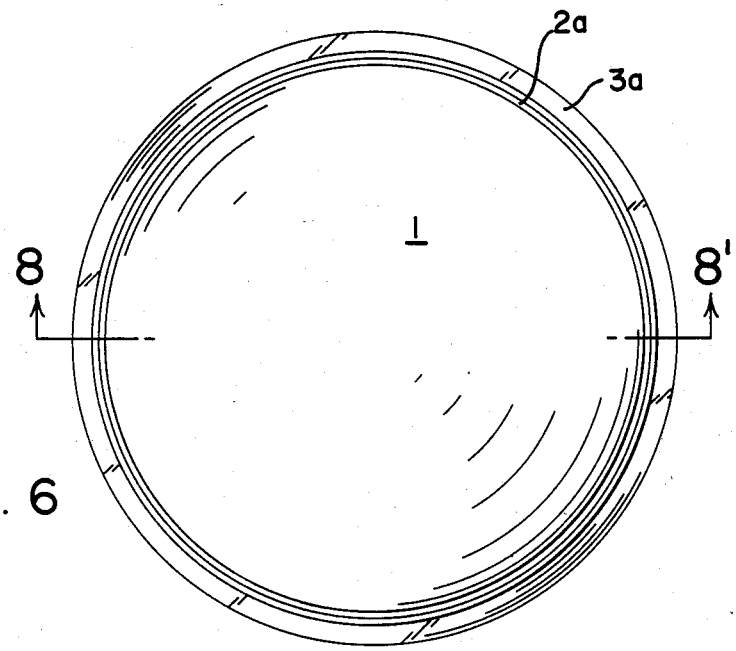
FIG. 6
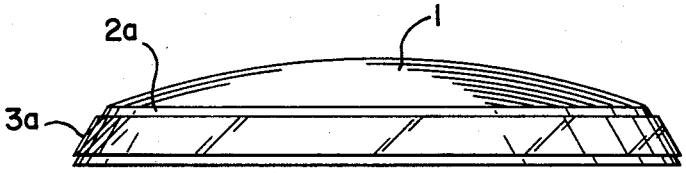
FIG. 7
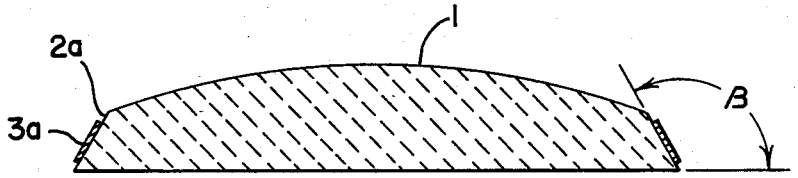
FIG. 8

RETROREFLECTIVE DEVICE HAVING CURVED RETROREFLECTIVE SURFACE

This invention relates to a retroreflective device which may be used wherever light reflection is desired. A principal application of the instant device is as a highway lane divider or road marker, to enhance automotive highway safety, particularly at night, and the invention is therefore described primarily with respect to this use.

BACKGROUND OF THE INVENTION

Roadmarkers are mounted on the surface of a roadway, such as along its center line or shoulders, to delineate paths or lanes for fast-moving traffic, or at intersections to define left-turn lanes, stopping lines or cross-lanes for traffic, both vehicular and pedestrian. Markers of this type are mounted in spaced apart relationship and serve to guide traffic in following or traversing a roadway, or in following a curve or grade in the roadway. Particularly, to assist a driver of a vehicle at night, these markers have light reflectors which catch and return rays of light from vehicle headlights back toward the driver. Road markers further contribute to traffic safety when roads are wet from rain, when fog tends to obscure the center line or shoulder boundaries, or when the glare of oncoming headlights makes it difficult to discern center lines or shoulder boundary markers. Indeed, under the conditions described above, road markers can frequently be the only means of orienting a driver to a change in the direction of a highway.

Many forms of light reflectors have been suggested and patented, but they all suffer from one or more limitations, such as reflecting too small a proportion of incident light back toward an approaching vehicle, or in reflecting back insufficient light such as on an inside or outside curve, when the vehicle's headlights' beams are not at precisely 90° with respect to a flat reflective roadmarker face. Furthermore, for any given set of vehicle headlights, there will be an optimum distance ahead of the vehicle when maximum reflectivity is realized from conventional roadmarkers, with such roadmarkers more distant, and those closer to the vehicle, reflecting less light. The driver of the vehicle therefore, has the benefit of only a relatively short segment of continuing reflectivity during forward progress.

In order to avoid interference with traffic, roadmarkers are usually of a relatively low-profile configuration, so that wheeled traffic is free to roll over them without appreciably interfering with the forward progress of the vehicle. Exemplary of such roadmarkers which have proved moderately successful in the past are those covered by the U.S. Pat. No. 3,332,327, to Heenan, issued in July, 1967. That roadmarker was characterized by having a pair of substantially flat, planar retroreflective faces reflecting in opposite directions, to thereby serve as a centerline marker or lane divider, for traffic traveling in opposite directions. Preferably, the planar face of the Heenan roadmarker formed an angle of 30° with the supporting pavement.

U.S. Pat. No. 4,076,383 to Heasley, issued in February, 1978, exemplifies an attempt to increase the efficiency of a retroreflective roadmarker by coacting three, retroreflective, substantially planar faces adapted to intercept light that was to be retroreflected.

One of the principal drawbacks of both the Heenan and Heasley retroreflectors is that, by design, they return most retroreflected light in a path substantially parallel to that of the incident light. In other words, as the incident light strikes the planar faces of Heenan and Heasley at an increasing angle past 90°, less and less retroreflected light is observed by the driver of the vehicle.

In other words, unless the incident light from an oncoming vehicle is substantially normal to the leading edge of a planar retroreflector, there is a reduction in reflected light back toward the driver, which reduction increases proportionately to the reduced angle at which the incident light strikes the planar retroreflector, vis-a-vis a line describing its leading, straight edge.

SUMMARY OF THE INVENTION

Quite surprisingly, and contrary to every expectation, it has been discovered that multi-directional efficiency of a highway retroreflector is infinitely improved by utilizing a curved retroreflective face, said curve being in an essentially horizontal plane, about an essentially vertical axis.

As is well known, if one views a segment of a cylinder having essentially a vertical axis, the vertical area of that cylinder normal to the line of sight, is represented by a line having zero thickness. Consequently, if such cylindrical segment surface were highly retroreflective, every expectation would be that the light reflected back toward the observer would theoretically be zero, or so infinitesimally minute, as to render the device useless from the retroreflective standpoint.

However, using a standard testing procedure, approved by one of the State Departments of Transportation, it has been quantitatively demonstrated that a retroreflector, curved about a substantially vertical axis, retroreflects an exceedingly high incidence of light parallel to radial, incident light, back toward the observer. Furthermore, for whatever reason, the angle at which the incident light strikes the curved roadmarker, becomes essentially immaterial since it is circular.

Consequently, the roadmarker of this invention comfortably exceeds most minimal state's standards for direct 90° retroreflectivity, and far exceeds the performance required by those standards for reflectivity at increasing angles. The roadmarker of this invention essentially equals the 90° reflectivity of planar retroreflective devices used until now, and far surpasses them in angular reflectivity, all as will be quantitatively demonstrated hereinafter.

BRIEF DESCRIPTION OF THE DRAWINGS

In the accompanying drawings:

FIG. 1 is a perspective view of a roadmarker embodying the present retroreflective surface;

FIG. 2 is an elevation view of the marker of FIG. 1;

FIG. 3 is a plan view of the road marker of FIG. 1;

FIG. 4 is a cross-sectional view of FIG. 3, taken along the line 4—4';

FIG. 5 is a perspective view of a slightly modified version of the instant invention;

FIG. 6 is a plan view of the roadmarker depicted in FIG. 5;

FIG. 7 is a side elevation view of the roadmarker depicted in FIG. 5; and FIG. 8 is a cross-sectional view of the roadmarker depicted in FIG. 6, taken along the line 8—8'.

DESCRIPTION OF THE PREFERRED EMBODIMENTS

The cylindrical, low-profile roadmarker of the instant invention is depicted generally by the reference numeral 1, in FIGS. 1–4 inclusive. The body of the roadmarker may be constructed of metal, suitable synthetic plastic resin, or ceramic. This is a matter of choice and the structural material employed forms no part of this invention. The particular embodiment depicted however, was manufactured of a suitable ceramic body, which can be glazed yellow, white, or any desirable color using conventional techniques. In the preferred embodiment, the vertical face 2 of the white marker was approximately 11 mm high. Completely surrounding the vertical face 2, was a strip of white, clear polycarbonate reflective tape approximately 6 mm wide, designated by the reference numeral 3. The retroreflective tape is available from Reflexite Corporation of New Britain, Connecticut under the trademark REFLEXITE, and may be affixed to the vertical face of the roadmarker via its waterproof, self-adhesive, backing.

As depicted in FIG. 4, the preferred angle $\alpha$ ranges from 90° to 100°. As will be readily apparent, the cylindrical, retroreflector face segment is essentially vertical with respect to the underlying pavement, and the surface of said retroreflective element, when viewed in cross-section, is represented by essentially a straight line, as best seen in FIG. 4.

FIG. 5 is a modified form of the preferred embodiment hereof, wherein the ceramic body of the roadmarker has been formed in the shape of a conical frustum.

FIGS. 6, 7 and 8 are counterparts of FIGS. 2–4 inclusive, and from FIG. 8 it will be noted that the slope of the face 2*a* of the frusto-conical roadmarker may repose at the angle $\beta$, which may range from 90° to 150°. As in the case of the cylindrical, low-profile marker, the retroreflective surface 3*a* of the frusto-conical marker, when viewed in cross-section as shown in FIG. 8, is described by a substantially straight line.

Dimensions, as such, are not critical to the instant invention, although it has been found, as a practical matter, that the radius of the cylinder of which the retroreflective element 3 is a segment, as depicted in FIG. 2, should be at least 2.54 cm.

In like manner, when the retroreflector 3*a*, shown in FIG. 8, represents a frusto-conical surface, its radius, measured at the upper edge of the retroreflector 3*a* as depicted in FIG. 8, should be at least 2.54 cm.

QUANTITATIVE EVALUATION OF THE INVENTION

There is what has been designated "Departmental Material Specification: D-9-4300 Traffic Buttons", promulgated by the Texas State Department of Highways and Public Transportation. There is designated therein "Test Method Tex-842-B" for determining specific intensity per reflective face according to certain designated criteria, at 4° and 20° horizontal entrance angles. Minimal requirement in this regard of the Texas State Highway Department is 3.00 for a clear white retroreflective element at a 4° entrance angle, and 1.50 at an entrance angle of 20°. Entrance angles are measured from a line normal to the leading edge of the reflector, when viewed from above.

Utilizing the foregoing procedure, a commercially available roadmarker, marketed by Amerace Corporation, apparently covered by the claims of the U.S. Pat. No. 3,332,327 to Heenan was tested. Its specific intensity at 4° was 3.84, and at 20°, 2.61 for a loss of 32%.

Next, the circular roadmarker of the instant invention was tested, using the identical procedures, and demonstrated a specific intensity at 4° of 3.53, and a specific intensity of 3.53 at 20°, for a loss difference of 0%. Most surprisingly, is the fact that, at a 4° entrance angle, for all practical purposes, the specific intensity of the circular retroreflective device of the instant invention was substantially equal to that of the patented retroreflective roadmarker with the planar face. Because of the 360° face of the instant invention, there was obviously no loss due to an increased entrance angle.

Again, the actual surface area facing a source of incident light, of the marker of the instant invention, is theoretically zero. Therefore, the performance of the instant marker, vis-a-vis a tried, proven and patented marker having a planar face with a total reflective surface area infinitely greater than that of the instant invention, from the standpoint of reflective area normal to 90° incident light, would seem to defy logical explanation, and is totally and completely unexpected.

In passing, it should be noted that U.S. Pat. No. 3,980,393 to Heasley, discloses a roadmarker having a curved surface.

However, the curved surface is essentially nothing more than a magnifying lens, with the reflective surface behind it being planar and essentially straight in all directions, i.e., height and width, much the same as Heenan's.

Furthermore, the magnifying lens 15 of Heasley, is curved about a horizontal axis, and again, the actual retroreflective element behind the lens, is nothing more than a conventional, cube-corner, planar retroreflector.

I claim:

1. In a relatively low-profile, retroreflective highway lane divider and boundary marker having a refroreflective element with an outer reflective surface, the improvement of said refroreflective element of said marker having a curved surface, as seen from a plan view of said marker, any selected segment of which surface constitutes a surface section of a cylinder having a generally vertical axis and a radius of at least 2.5 cm., said segment's outer surface, when seen from an elevational, cross-sectional view, represented by essentially a straight line, said straight line substantially parallel to said vertical axis.

2. The roadmarker of claim 1 wherein the refroreflective surface element forms an angle of approximately 90° with the supporting pavement.

3. The roadmarker of claim 1 wherein the roadmarker is circular when observed from a plan view, and the refroreflective element completely encircles said marker.

* * * * *

UNITED STATES PATENT AND TRADEMARK OFFICE

CERTIFICATE OF CORRECTION

PATENT NO. : 4,653,955

DATED : March 31, 1987

INVENTOR(S) : Robert R. Racs

It is certified that error appears in the above—identified patent and that said Letters Patent is hereby corrected as shown below:

In column 4, claim 1, lines 44-45, the word--refroreflective-- should be "retroreflective."

In column 4, claim 1, line 46, the word--refroreflective-- should be "retroreflective."

In column 4, claim 2, lines 55-56, the word--refroreflective-- should be "retroreflective."

In column 4, claim 3, line 60, the word--refroreflective-- should be "retroreflective."

Signed and Sealed this

Fifteenth Day of September, 1987

*Attest:*

DONALD J. QUIGG

*Attesting Officer*

*Commissioner of Patents and Trademarks*